US011464312B2

(12) United States Patent
Pang et al.

(10) Patent No.: US 11,464,312 B2
(45) Date of Patent: Oct. 11, 2022

(54) HAIR CARE DEVICE WITH AT LEAST TWO ATTACHMENTS

(71) Applicant: KONINKLIJKE PHILIPS N.V., Eindhoven (NL)

(72) Inventors: Chuen Yu Cyrus Pang, Fanling (CN); Cho Woo, Hong Kong (CN); Wing-Hei Cho, Hong Kong (CN)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 449 days.

(21) Appl. No.: 16/614,837

(22) PCT Filed: Jun. 8, 2018

(86) PCT No.: PCT/EP2018/065132
§ 371 (c)(1),
(2) Date: Nov. 19, 2019

(87) PCT Pub. No.: WO2018/224639
PCT Pub. Date: Dec. 13, 2018

(65) Prior Publication Data

US 2020/0178667 A1 Jun. 11, 2020

(30) Foreign Application Priority Data

Jun. 9, 2017 (EP) ..... 17175366
Nov. 21, 2017 (EP) ..... 17202752

(51) Int. Cl.
*A45D 20/12* (2006.01)
*A45D 20/26* (2006.01)

(52) U.S. Cl.
CPC ..... *A45D 20/12* (2013.01); *A45D 20/26* (2013.01)

(58) Field of Classification Search
CPC ..... A45D 20/12; A45D 20/122
See application file for complete search history.

(56) References Cited

U.S. PATENT DOCUMENTS 9,808,065 B2 * 11/2017 Moloney ..... A45D 20/50
9,808,067 B2 * 11/2017 Sutter ..... A45D 20/12
(Continued)

FOREIGN PATENT DOCUMENTS

DE 2830535 1/1980
DE 19835791 2/1999
(Continued)

OTHER PUBLICATIONS

International Search Report and Written Opinion dated Sep. 7, 2018 for International Application No. PCT/EP2018/065132 Filed Jun. 8, 2018.

(Continued)

*Primary Examiner* — Gregory A Wilson

(57) ABSTRACT

A hair care device comprises a body having an output to supply heated air, and at least two different attachments that can be attached to the output of the body. In accordance with the invention, the body comprises a detector for detecting whether one of the attachments is attached to the body, and if so, which attachment is attached to the body, to provide a detection result, and a controller for controlling the supply of heated air in dependence on the detection result. According to the invention, each attachment has at least one magnet at predefined positions at an attachment contact area of the attachment for contacting the body, the at least two attachments having mutually different magnet configurations, and the detector comprises a plurality of Hall effect sensors at predefined positions (■) at a body contact area for contacting a selected one of the attachments.

15 Claims, 2 Drawing Sheets

(56) References Cited

U.S. PATENT DOCUMENTS

| | | | | |
|---|---|---|---|---|
| 10,165,844 | B2 * | 1/2019 | Stephens | A45D 20/122 |
| 10,716,391 | B2 * | 7/2020 | Balooch | A61B 5/448 |
| 11,253,040 | B2 * | 2/2022 | Kim | A45D 20/122 |
| 2002/0129454 | A1 | 9/2002 | Hilscher | |
| 2009/0140730 | A1 | 6/2009 | Newman | |
| 2011/0277335 | A1 | 11/2011 | Prehodka | |
| 2013/0144280 | A1 | 6/2013 | Eckhouse | |
| 2014/0212833 | A1 | 7/2014 | Mangelberger | |
| 2015/0177731 | A1 | 6/2015 | Mader | |
| 2016/0135565 | A1 | 5/2016 | Yu | |
| 2018/0042356 | A1 * | 2/2018 | Pavis | A45D 20/10 |
| 2021/0307473 | A1 * | 10/2021 | Conrad | A45D 20/12 |

FOREIGN PATENT DOCUMENTS

| | | | |
|---|---|---|---|
| EP | 2803768 | | 11/2014 |
| FR | 3026927 | | 4/2016 |
| GB | 2515808 | | 1/2015 |
| JP | 54033154 | A | 3/1979 |
| JP | 2004521691 | A | 11/2008 |
| WO | 02/071971 | A1 | 9/2002 |
| WO | 2014201146 | | 12/2014 |
| WO | 2015169606 | | 11/2015 |

OTHER PUBLICATIONS

International Preliminary Report on Patentability dated Jul. 10, 2019 for International Application No. PCT/EP2018/065132 Filed Jun. 8, 2018.

* cited by examiner

HAIR CARE DEVICE WITH AT LEAST TWO ATTACHMENTS

CROSS REFERENCE TO RELATED APPLICATIONS

This application is the U.S. National Phase application under 35 U.S.C. § 371 of International Application No. PCT/EP2018/065132 filed Jun. 8, 2018, published as WO 2018/224639 on Dec. 13, 2018, which claims the benefit of European Patent Application Number 17175366.8 filed Jun. 9, 2017 and European Patent Application Number 17202752.6 filed Nov. 21, 2017. These applications are hereby incorporated by reference herein.

FIELD OF THE INVENTION

The invention relates to a hair care device with at least two attachments.

BACKGROUND OF THE INVENTION

DE19835791 discloses a warm air hair drier. The drier has a device to raise/control temperature of warm air coming out according to shape of nozzle or drying attachment used. A hand apparatus with an electrical heating installation and a fan to dry hair using warm air at a specified temperature (set point value) has shaped nozzles or drying attachments that can be set on the air outlet opening. A device is present which influences the warm air temperature with dependence upon the attachment used. There are devices on the attachment determining the dependence. The first-mentioned device raises the warm air temperature depending upon the attachment up to a specified value. An electronic temperature control unit for the warm air temperature (set point value) is provided. In the apparatus, a temperature sensor is located from which a measurement signal (actual value) is passed to an electronic control unit, compared with the specified set point warm air temperature and controlled. The attachment is provided with a coding device, and the body with a decoding device for detecting a predetermined hot air temperature (set temperature) by the coding device on the attachment. As an encoder, the attachment has a corresponding shape formation on a projection which corresponds to a displaceable, spring-loaded stop of a shift rod which is connected to a switch in the body. Depending on the position of the stop of the switch (tap changer) the predetermined hot air temperature is raised.

In a typical hair dryer or air styler, when an attachment is plugged in, it naturally affects the air flow and heat output. A lot of times the resultant output might not be optimal for that attachment type.

SUMMARY OF THE INVENTION

It is, inter alia, an object of the invention to provide an improved hair care device. The invention is defined by the independent claims. Advantageous embodiments are defined in the dependent claims.

With the smart attachment detection feature of the invention, the dryer is able to detect the type of attachment or nozzle that is plugged in, and adjust the air speed and/or heat settings automatically, so that the attachments can provide their optimal performances meeting their defined purposes. Users will no longer need to determine which setting to choose to get the correct output.

These and other aspects of the invention will be apparent from and elucidated with reference to the embodiments described hereinafter.

DESCRIPTION OF EMBODIMENTS

Figure 1:
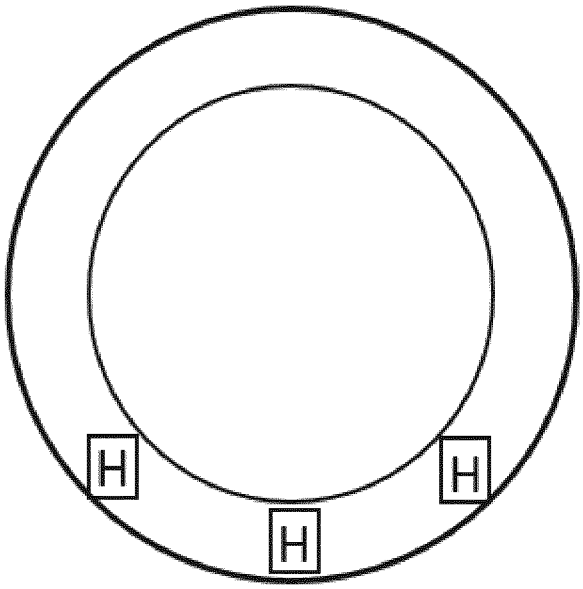
FIG. 1 illustrates a first embodiment of the invention.

FIG. 1 illustrates a first embodiment of the invention. FIG. 1 shows an example of an air outlet side of a body of a hair dryer in accordance with the invention. In this example, at the bottom of the air outlet side, 3 Hall effect sensors H are present. If the hair dryer has 3 different attachments, each having 1 magnet at respective positions facing mutually different ones of the 3 Hall effect sensors H in the body, a processor in the body is able to determine which attachment has been attached to the body of the hair dryer, as only the one Hall effect sensor in proximity with the magnet on the attached attachment will indicate the presence of a magnet.

Figure 2:
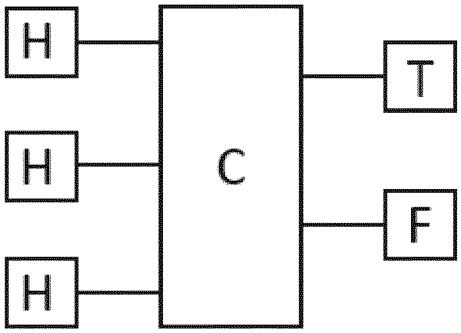
FIG. 2 illustrates an embodiment of a hair dryer in accordance with the invention.

FIG. 2 illustrates an embodiment of a hair dryer in accordance with the invention. The 3 Hall effect sensors H of FIG. 1 are connected to inputs of a controller C, which on the basis of the attachment type thus detected, controls a fan F and/or an air temperature T so as to automatically adjust the air speed and/or heat settings. In a first implementation, the controller C simply changes the heater output to a specific pre-set setting depending on the particular type of attachment (nozzle) that has been detected; so every time that it gets plugged in, we can expect a certain temperature and/or air speed because the characteristics of the nozzle are already known. In an alternative implementation, the controller C has a feedback loop in which the amount of heat supplied and/or the air speed further depend on a measured temperature obtained by a temperature sensor.

Figure 3A:
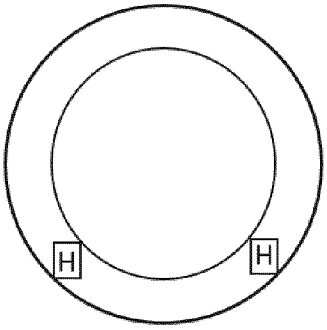
FIGS. 3*a*-3*d* illustrate a second embodiment of the invention.
Figure 3B:
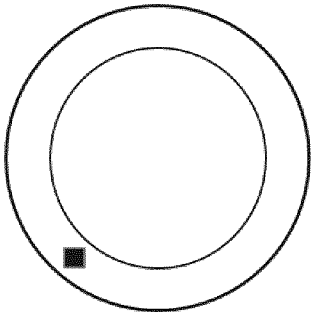
Figure 3C:
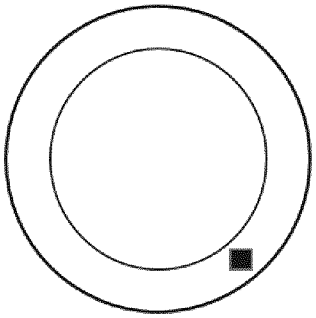
Figure 3D:
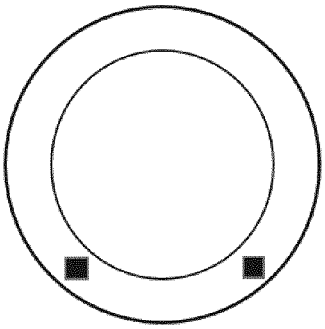

Alternatively, in a variation of the configuration shown in FIG. 1, the body has only 2 Hall effect sensors (e.g. the middle Hall effect sensor H in FIGS. 1 and 2 has been left out), as shown in FIG. 3*a*. In such a configuration, the processor in the body is able to detect which one of 2 different attachments is attached to the body in the same way as described above in relation to FIG. 1. The two different attachments would then have magnet positions as indicated with black squares in FIGS. 3*b* and 3*c*, respectively. However, it is even possible to detect a third attachment, if that third attachment has 2 magnets at respective positions facing the 2 Hall effect sensors on the body, as shown in FIG. 3*d*. The processor in the body would then conclude that the third attachment is attached to the body if both Hall effect sensors indicate that they are in close proximity with a magnet.

In summary, a hair care device comprises a body having an output to supply heated air, and at least two different attachments that can be attached to the output of the body. In accordance with the invention, the body comprises a detector for detecting whether one of the attachments is attached to the body, and if so, which attachment is attached to the body, to provide a detection result, and a controller for controlling the supply of heated air in dependence on the detection result. In accordance with the invention, each attachment has at least one magnet at predefined positions at an attachment contact area of the attachment for contacting the body, the at least two attachments having mutually different magnet configurations, and the detector comprises a plurality of Hall effect sensors at predefined positions at a body contact area for contacting a selected one of the attachments. In one implementation thereof, each attachment has a single magnet, and the detector comprises for each of the attachments a separate Hall effect sensor at a location at the body contact area that after the attachment has been attached to the body faces the location on the attachment where the attachment's magnet is positioned. In an alternative implementation, a first attachment has one magnet at a first position, a second attachment has one magnet at a second position different from the first position, a third attachment has magnets at the first and second positions, and the detector has first and second Hall effect sensors at respective positions facing the first and second positions.

The invention can be applied to hair dryers and air stylers. The various different attachments could include a nozzle for a focused airflow, a retractable bristle brush for tangle-free waves and curls, a paddle straightening brush for naturally straight looks, a thermobrush for smoothing and for waves, and a volumes for volume at the roots. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The controller may be implemented by means of hardware comprising several distinct elements, and/or by means of a suitably programmed processor. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A hair care device comprising:

a hair care device body having an output to supply heated air; and at least two different types of hair care device attachments that can be attached to the output of the hair care device body;

wherein the hair care device body comprises:

a detector for detecting whether one of the types of hair care device attachments is attached to the hair care device body, and if so, which type of hair care device attachment is attached to the hair care device body, to provide a detection result, and a controller for controlling the supply of heated air in dependence on the detection result, wherein each hair care device attachment has one or more magnets at a contact area of the hair care device attachment for contacting the hair care device body, the at least two types of hair care device attachments having mutually different magnet position configurations; and wherein the detector comprises a plurality of Hall effect sensors at predefined positions at the output for contacting the one or more magnets of the hair care device attachments.

2. The hair care device as claimed in claim 1, wherein each type of hair care device attachment has a single magnet, and the detector comprises for each type of the hair care device attachments a separate Hall effect sensor at a location at the output that—after the hair care device attachment has been attached to the hair care device body—faces the location on the hair care device attachment where the hair care device attachment's magnet is positioned.

3. The hair care device as claimed in claim 1, wherein a first type of hair care device attachment has one magnet at a first position, a second type of hair care device attachment has one magnet at a second position different from the first position, a third type of hair care device attachment has magnets at the first and second positions, and the detector has first and second Hall effect sensors at respective positions facing the first and second positions.

4. The hair care device as claimed in claim 1, wherein the hair care device body further comprises a fan, wherein each of the plurality of Hall effect sensors is connected to an input of the controller, such that the controller automatically adjusts air speed and/or heat settings based on the detection result.

5. The hair care device as claimed in claim 1, wherein the controller changes a heater output to a preset setting based on the type of hair care device attachment detected.

6. A hair care device body comprising:

an output to supply heated air, to which output any one of at least two different types of hair care device attachments can be attached;

a detector for detecting whether one of the at least two different types of hair care device attachments is attached to the hair care device body, and if so, which type of hair care device attachment is attached to the hair care device body, to provide a detection result; and a controller for controlling the supply of heated air in dependence on the detection result, wherein the detector comprises a plurality of Hall effect sensors at the output for contacting at least one magnet at a contact area of the hair care device attachment for contacting the hair care device body, the at least two different types of hair care device attachments having mutually different magnet position configurations, whereby the detector is able to detect which type of hair care device attachment is attached to the hair care device body.

7. The hair care device body as claimed in claim 6, wherein the detector comprises for each type of the hair care device attachments, a separate Hall effect sensor at a location at the output that—after the hair care device attachment has been attached to the hair care device body—faces the location on the hair care device attachment where the hair care device attachment's magnet is positioned.

8. The hair care device body as claimed in claim 6, wherein for detecting a first type of hair care device attachment having one magnet at a first position, a second type of hair care device attachment having one magnet at a second position different from the first position, or a third type of hair care device attachment having magnets at the first and second positions, the detector has first and second Hall effect sensors at respective positions facing the first and second positions.

9. The hair care device as claimed in claim 6, further comprising a temperature sensor, wherein the controller has a feedback loop in which an amount of heat supplied and/or air speed further depends on a measured temperature obtained by the temperature sensor.

10. The hair care device as claimed in claim 6, wherein the hair care device body further comprises a fan, wherein each of the plurality of Hall effect sensors is connected to an input of the controller, such that the controller automatically adjusts air speed and/or heat settings based on the detection result.

11. The hair care device as claimed in claim 6, wherein the controller changes a heater output to a preset setting based on the type of hair care device attachment detected.

12. The hair care device as claimed in claim 6, further comprising a temperature sensor, wherein the controller has a feedback loop in which an amount of heat supplied and/or air speed further depends on a measured temperature obtained by the temperature sensor.

13. A set of at least two different hair care device attachments for use with a hair care device body having an output to supply heated air, to which output any one of the at least two different hair care device attachments can be attached, wherein each hair care device attachment has one or more magnets at predefined positions at an attachment contact area of the hair care device attachment for contacting the body, the at least two different hair care device attachments having mutually different magnet position configurations, wherein the one or more magnets are configured to couple to corresponding Hall effect sensors having predefined positions on the hair care device body.

14. The set of at least two different hair care device attachments as claimed in claim 13, wherein each hair care device attachment has a single magnet.

15. The set of at least two different hair care device attachments as claimed in claim 13, wherein a first hair care device attachment has one magnet at a first position, a second hair care device attachment has one magnet at a second position different from the first position, and a third hair care device attachment has magnets at the first and second positions.

* * * * *